US009243458B2

(12) United States Patent
Bilen et al.

(10) Patent No.: US 9,243,458 B2
(45) Date of Patent: Jan. 26, 2016

(54) METHODS FOR PRE-SHARPENING IMPREGNATED CUTTING STRUCTURES FOR BITS, RESULTING CUTTING STRUCTURES AND DRILL BITS SO EQUIPPED

(71) Applicant: Baker Hughes Incorporated, Houston, TX (US)

(72) Inventors: J. Miguel Bilen, The Woodlands, TX (US); Victor L. Reddick, Jr., Huntsville, TX (US); Wesley Dean Fuller, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 346 days.

(21) Appl. No.: 13/779,307

(22) Filed: Feb. 27, 2013

(65) Prior Publication Data

US 2014/0238752 A1 Aug. 28, 2014

(51) Int. Cl.

| | |
|---|---|
| ***E21B 10/46*** | (2006.01) |
| ***B24B 53/00*** | (2006.01) |
| ***B24D 99/00*** | (2010.01) |
| ***E21B 41/00*** | (2006.01) |

(52) U.S. Cl.

CPC ..... *E21B 10/46* (2013.01); *B24B 53/001* (2013.01); *B24D 99/005* (2013.01); *E21B 41/0035* (2013.01)

(58) Field of Classification Search

CPC ..... E21B 10/36; E21B 10/43; E21B 10/46; E21B 10/52; E21B 10/55; E21B 10/567; E21B 10/58; E21B 10/62; B23K 26/0021

See application file for complete search history.

(56) References Cited

U.S. PATENT DOCUMENTS

| | | | | |
|---|---|---|---|---|
| 4,913,244 | A * | 4/1990 | Trujillo | 175/65 |
| 4,943,488 | A | 7/1990 | Sung et al. | |
| 5,049,164 | A | 9/1991 | Horton et al. | |
| 5,447,208 | A * | 9/1995 | Lund et al. | 175/428 |
| 5,967,245 | A * | 10/1999 | Garcia et al. | 175/374 |
| 6,401,844 | B1 | 6/2002 | Doster | |
| 6,458,471 | B2 | 10/2002 | Lovato et al. | |
| 6,510,906 | B1 | 1/2003 | Richert et al. | |
| 6,575,256 | B1 * | 6/2003 | Doster | 175/431 |
| 6,708,785 | B1 | 3/2004 | Russell et al. | |
| 6,843,333 | B2 | 1/2005 | Richert et al. | |
| 7,278,499 | B2 | 10/2007 | Richert et al. | |
| 7,316,279 | B2 * | 1/2008 | Wiseman | E21B 10/46 175/428 |
| 7,497,280 | B2 | 3/2009 | Brackin et al. | |
| 7,730,976 | B2 | 6/2010 | McClain et al. | |
| 8,191,657 | B2 | 6/2012 | Richert et al. | |
| 8,220,567 | B2 | 7/2012 | Scott et al. | |
| 8,333,814 | B2 | 12/2012 | Brackin et al. | |
| 2001/0047891 | A1 * | 12/2001 | Truax et al. | 175/426 |
| 2004/0228694 | A1 * | 11/2004 | Webb et al. | 407/113 |
| 2006/0060390 | A1 | 3/2006 | Eyre | |
| 2007/0106487 | A1 * | 5/2007 | Gavia | E21B 10/00 703/7 |
| 2008/0017421 | A1 * | 1/2008 | Lockwood | 175/434 |
| 2009/0114628 | A1 * | 5/2009 | DiGiovanni | 219/121.72 |
| 2010/0122848 | A1 | 5/2010 | McClain | |
| 2010/0219000 | A1 | 9/2010 | Doster | |
| 2011/0061943 | A1 | 3/2011 | Richert | |
| 2011/0083907 | A1 * | 4/2011 | Israelsson et al. | 175/428 |

* cited by examiner

*Primary Examiner* — Cathleen Hutchins
(74) *Attorney, Agent, or Firm* — TraskBritt

(57) ABSTRACT

Processes for pre-sharpening cutting structures comprising particles of superabrasive material such as diamond grit, dispersed in a metal matrix material such as cemented tungsten carbide. Matrix material may be removed from a surface of a cutting structure to a desired depth to expose superabrasive particles within the matrix material adjacent the surface, and to increase exposure of partially exposed superabrasive particles at the surface. Electrodischarge machining (EDM), laser machining, electrolytic etching and chemical etching may also be employed. Pre-sharpened cutting structures are also disclosed.

21 Claims, 11 Drawing Sheets

METHODS FOR PRE-SHARPENING IMPREGNATED CUTTING STRUCTURES FOR BITS, RESULTING CUTTING STRUCTURES AND DRILL BITS SO EQUIPPED

FIELD

The present disclosure relates generally to methods for pre-sharpening so-called "impregnated" cutting structures comprising superabrasive material particles fixed in a matrix of metal material, such cutting structures being secured to or formed integrally with a body of a rotary drill bit, as well as to resulting cutting structures and drill bits so equipped.

BACKGROUND

Impregnated drag bits are used conventionally for drilling hard and/or abrasive rock formations, such as sandstones. These impregnated drill bits typically employ a cutting face composed of superabrasive cutting particles, such as natural or synthetic diamond grit, dispersed within a matrix of wear-resistant material. As such a bit drills, the matrix and embedded diamond particles wear, worn cutting particles are lost and new cutting particles are exposed. These diamond particles may either be natural or synthetic and may be cast integral with the body of the bit, as in low-pressure infiltration, or may be preformed separately, as in hot isostatic pressure infiltration, and attached to the bit by brazing or furnaced to the bit body during manufacturing thereof by an infiltration process.

Conventional impregnated bits generally exhibited a poor hydraulics design by employing a crow's foot to distribute drilling fluid across the bit face and providing only minimal flow area. Further, conventional impregnated bits did not drill effectively when the bit encountered softer and less abrasive layers of rock, such as shales. When drilling through shale, or other soft formations, with a conventional impregnated drag bit, the cutting structure tended to quickly clog or "ball up" with formation material, making the drill bit ineffective. The softer formations can also plug up fluid courses formed in the drill bit, causing heat buildup and premature wear of the bit. Therefore, when shale-type formations were encountered, a more aggressive bit was desired to achieve a higher rate-of-penetration (ROP). It followed, therefore, that selection of a bit for use in a particular drilling operation became more complicated when it was expected that formations of more than one type would be encountered during the drilling operation.

Moreover, during the drilling of a well bore, the well may be drilled in multiple sections wherein at least one section is drilled followed by the cementing of a tubular metal casing within the borehole. In some instances, several sections of the well bore may include casing of successively smaller sizes, or a liner may be set in addition to the casing. In cementing the casing (such term including a liner) within the borehole, cement is conventionally disposed within an annulus defined between the casing and the borehole wall by flowing the cement downwardly through the casing to the bottom thereof and then displacing the cement through a so-called "float shoe" such that it flows back upwardly through the annulus. Such a process conventionally results in a mass or section of hardened cement proximate the float shoe and formed at the lower extremity of the casing. Thus, in order to drill the well bore to further depths, it becomes necessary to first drill through the float shoe and mass of cement.

Conventionally, the drill bit used to drill out the cement and float shoe did not exhibit the desired design for drilling the subterranean formation, which lies therebeyond. Those drilling the well bore were then often faced with the decision of changing out drill bits after the cement and float shoe had been penetrated or, alternatively, continuing with a drill bit that may not have been optimized for drilling the subterranean formation below the casing.

Thus, it was recognized as beneficial to design a drill bit that would perform more aggressively in softer, less abrasive formations while also providing adequate ROP in harder, more abrasive formations and for drilling such formations interbedded with soft and nonabrasive layers without requiring increased weight-on-bit (WOB) during the drilling process.

Additionally, it was also recognized as advantageous to provide a drill bit with "drill out" features to enable the drill bit to drill through a cement shoe and continue drilling the subsequently encountered subterranean formation in an efficient manner.

To address these needs, inventors of the assignee of the present disclosure developed and implemented a number of superior bit designs offered as HEDGEHOG® impregnated bits. A variety of structures for such bits and specific features thereof are disclosed and claimed in U.S. Pat. Nos. 6,510,906; 6,843,333; 7,278,499; 7,497,280; 7,730,976; 8,191,657; 8,220,567 and 8,333,814 and in U.S. Patent Publications 2010/0122848; 2010/0219000; and 2011/0061943, among others. The disclosure of each of the foregoing patents and patent publications is hereby incorporated herein in its entirety by this reference.

Notable features of the HEDGEHOG® impregnated bits include the use of impregnated cutting structures protruding above the bit face to an exposure far greater than was previously conventional and formed as posts, the use of nozzles and of relatively deep and wide fluid passages and junk slots for improved bit hydraulics, the use of polycrystalline diamond compact cutting elements in the bit cone for superior performance in interbedded and shaley formations, as well as the use of thermally stable polycrystalline diamond cutting elements in combination with impregnated posts and other impregnated cutting structures for enhanced drill out capability.

However, even such bits conventionally require a "break-in" period before attaining optimum performance, since the superabrasive particles in the as-formed cutting structures are substantially embedded in the matrix material of the cutting structure. Thus, in operation, a conventional impregnated bit would be run into a well and "broken-in" or "sharpened" by drilling into an abrasive formation at a selected WOB as the bit is rotated. For the first several feet of penetration, the diamond grit on the ends of the posts or other cutting structures becomes more exposed by wear of the relatively softer matrix material, as no substantial volume of diamond is usually exposed on an impregnated cutting structure as manufactured. As the bit is "sharpened" to enhance exposure of the diamond grit on formation-engaging surfaces of the impregnated cutting structures, ROP increases and stabilizes. It has been demonstrated that HEDGEHOG® impregnated bits, once broken in, exhibit an increased ROP over conventional impregnated bits. It has likewise been shown that HEDGEHOG® impregnated bits exhibit a substantially similar ROP to that of a conventional impregnated bit but at a reduced WOB.

However, the need to break in impregnated bits to achieve their full potential in terms of increased ROP and reduced required WOB is undesirable.

BRIEF SUMMARY

The present disclosure relates to pre-sharpening of impregnated cutting structures for use in drilling and enlarging wellbores through subterranean formations.

In one embodiment, a method of pre-sharpening a cutting structure for subterranean use and comprising superabrasive material particles dispersed in a metal matrix material comprises selecting a surface of the cutting structure and removing a depth of the metal matrix material from the selected surface to at least one of enhance exposure of superabrasive particles exposed above the selected surface and expose portions of unexposed superabrasive particles adjacent the selected surface.

In another embodiment, the present disclosure comprises an unused cutting structure for subterranean use comprising superabrasive particles dispersed in a metal matrix material and exhibiting substantial exposure of portions thereof above at least one surface of the metal matrix material of the cutting structure.

In a further embodiment, the present disclosure comprises a bit for subterranean use having at least one unused impregnated cutting structure thereon, the at least one unused cutting structure comprising particles dispersed in a metal matrix material and exhibiting substantial exposure of portions thereof above at least one surface of the metal matrix material.

DETAILED DESCRIPTION

The process of enhancing exposure of the abrasive particles of cutting structures according to embodiments of the present disclosure may be referred to herein as "pre-sharpening," which in its broadest sense comprises removing matrix material from a surface of a cutting structure to increase exposure of abrasive particles dispersed in the matrix material at or near the surface. As used herein, the term "cutting structure" means and includes, in its broadest sense, any structure of a drill bit comprising particulate abrasive material dispersed in a matrix material and located for eventual engagement with a subterranean formation material during a drilling operation. As used herein, the term "bit" means and include any type of bit or tool used for drilling during the formation or enlargement of a wellbore in a subterranean formation and includes, for example, fixed-cutter bits, roller cone bits, percussion bits, core bits, eccentric bits, bicenter bits, reamers, mills, drag bits, hybrid bits, and other drilling bits and tools known in the art.

Figure 1:
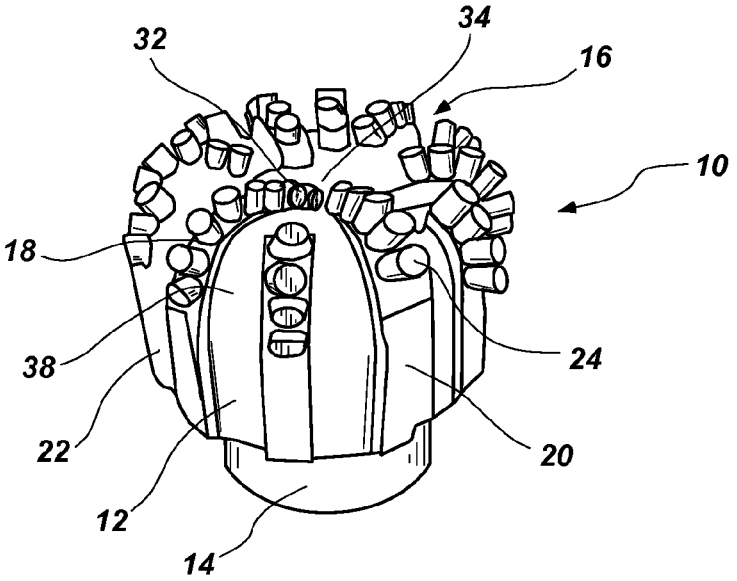
FIG. 1 comprises an inverted perspective view of a first embodiment of a bit of the present disclosure.
Figure 2A:
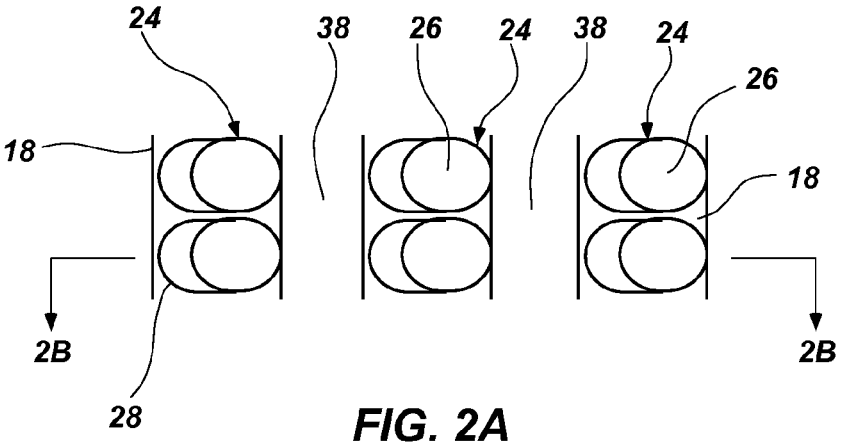
FIG. 2A is a schematic top elevation of portions of a plurality of blades of the bit of FIG. 1 carrying discrete cutting structures and FIG. 2B is a side sectional elevation taken across line 2B-2B of FIG. 2A.
Figure 2B:
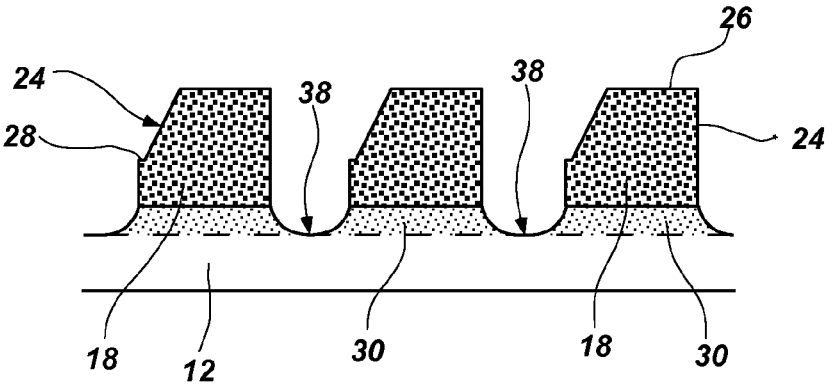
Figure 3:
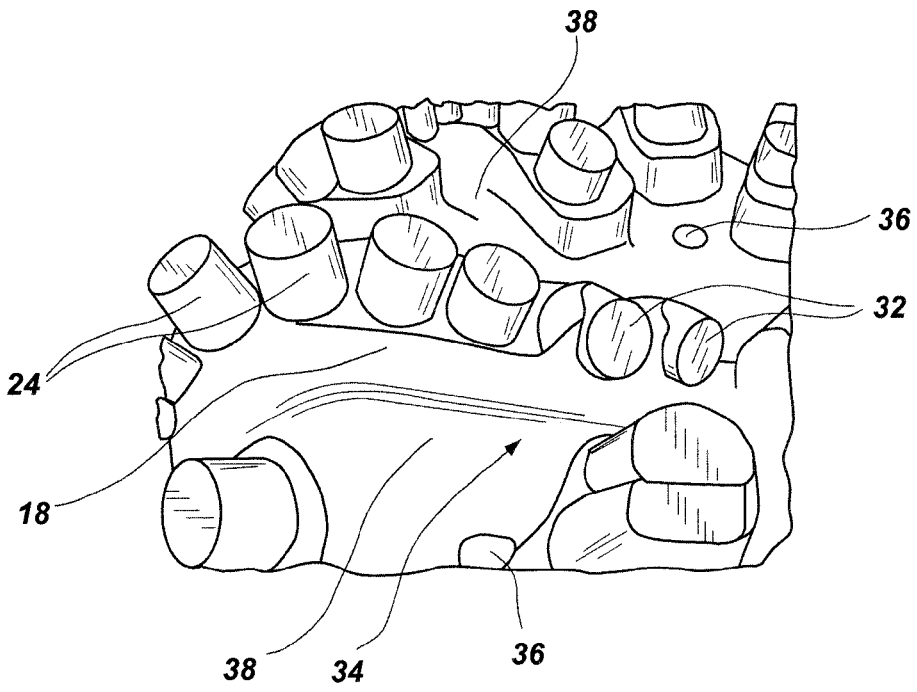
FIG. 3 is an enlarged, inverted perspective view of part of the cone portion of the face of the bit of FIG. 1, showing wear of discrete, diamond grit-impregnated cutting structures and PDC cutters.

Referring now to FIGS. 1-3 of the drawings, a first embodiment of a bit 10 of the present disclosure is depicted in perspective, bit 10 being inverted from its normal face-down operating orientation for clarity. Bit 10 is, by way of example only, of 8.5" diameter and includes a matrix-type bit body 12 having a shank 14 for connection to a drill string (not shown) extending therefrom opposite bit face 16. A plurality of (in this instance, twelve (12)) blades 18 extends generally radially outwardly in linear fashion to gage pads 20 defining junk slots 22 therebetween.

The discrete, impregnated cutting structures 24 comprise posts extending upwardly (as shown in FIG. 1) on blades 18 from the bit face 16. The cutting structures 24 may be formed as an integral part of the matrix-type blades 18 projecting from a matrix-type bit body 12 by hand-packing diamond grit-impregnated matrix material in mold cavities on the interior of the bit mold defining the locations of the cutting structures 24 and blades 18 and, thus, each blade 18 and associated cutting structure 24 defines a unitary structure. It is noted that the cutting structures 24 may be placed directly on the bit face 16, dispensing with the blades. However, as discussed in more detail below, it may be preferable to have the cutting structures 24 located on the blades 18. It is also noted that, while discussed in terms of being integrally formed with the bit 10, the cutting structures 24 may be formed as discrete individual segments, such as by hot isostatic pressing, and subsequently brazed or furnaced onto the bit 10.

Discrete cutting structures 24 are mutually separate from each other to promote drilling fluid flow therearound for enhanced cooling and clearing of formation material removed by the diamond grit. Discrete cutting structures 24, as shown in FIG. 1, are generally of a round or circular transverse cross-section at their substantially flat, outermost ends 26, but become more oval with decreasing distance from the face of the blades 18 and thus provide wider or more elongated (in the direction of bit rotation) bases 28 (see FIGS. 2A and 2B) for greater strength and durability. As the discrete cutting structures 24 wear (see FIG. 3), the exposed cross-section of the posts increases, providing progressively increasing contact area for the diamond grit with the formation material. As the discrete cutting structures 24 wear down, the bit 10 takes on the configuration of a heavier-set bit more adept at penetrating harder, more abrasive formations. Even if discrete cutting structures 24 wear completely away, the diamond-impregnated blades 18 will provide some cutting action, reducing any possibility of "ring-out" and having to pull the bit 10.

While the cutting structures 24 are illustrated as exhibiting posts of circular outer ends and oval shaped bases, other geometries are also contemplated. For example, the outermost ends 26 of the cutting structures 24 may be configured as ovals having a major diameter and a minor diameter. The base 28 adjacent the blade 18 might also be oval, having a major and a minor diameter, wherein the base 28 has a larger minor diameter than the outermost end 26 of the cutting structure 24. As the cutting structure 24 wears toward the blade 18, the minor diameter increases, resulting in a larger surface area. Furthermore, the ends of the cutting structures 24 need not be flat, but may employ sloped geometries. In other words, the cutting structures 24 may change cross-sections at multiple intervals, and tip geometry may be separate from the general cross-section of the cutting structure 24. Other shapes or geometries may be configured similarly. It is also noted that the spacing between individual cutting structures 24, as well as the magnitude of the taper from the outermost ends 26 to the blades 18, may be varied to change the overall aggressiveness of the bit 10 or to change the rate at which the bit is transformed from a light-set bit to a heavy-set bit during operation. It is further contemplated that one or more of such cutting structures 24 may be formed to have substantially constant cross-sections, if so desired, depending on the anticipated application of the bit 10.

Discrete cutting structures 24 may comprise a synthetic diamond grit, such as, for example, DSN-47 Synthetic diamond grit, commercially available from DeBeers of Shannon, Ireland, which has demonstrated toughness superior to natural diamond grit. The tungsten carbide matrix material with which the diamond grit is mixed to form discrete cutting structures 24 and supporting blades 18 may include a fine grain carbide, such as, for example, DM2001 powder commercially available from Kennametal Inc., of Latrobe, Pa. Such a carbide powder, when infiltrated, provides increased exposure of the diamond grit particles in comparison to conventional matrix materials due to its relatively soft, abradable nature. The base 30 of each blade 18 may be formed of, for example, a more durable 121 matrix material, obtained from Firth MPD of Houston, Tex. Use of the more durable material in this region helps to prevent ring-out even if all of the discrete cutting structures 24 are abraded away and the majority of each blade 18 is worn.

It is noted, however, that other particulate abrasive materials may be suitably substituted for those discussed above. For example, the discrete cutting structures 24 may include natural diamond grit, or a combination of synthetic and natural diamond grit. Particles of cubic boron nitride may also be employed, in addition to or in lieu of diamond particles. Alternatively, the cutting structures 24 may include synthetic diamond pins. Additionally, the particulate abrasive material may be coated with a single layer or multiple layers of one or more materials, as known in the art and disclosed in U.S. Pat. Nos. 4,943,488, 5,049,164 and 8,220,567, the disclosure of each of which is hereby incorporated herein in its entirety by reference. Such materials may include, for example and without limitation, a refractory metal, a refractory metal carbide, and a refractory metal oxide. In one embodiment, the coating may exhibit a thickness of approximately 1 to 10 microns. In another embodiment, the coating may exhibit a thickness of approximately 2 to 6 microns. In yet another embodiment, the coating may exhibit a thickness of less than 1 micron. In a further embodiment, the coating may exhibit a thickness of up to about 250 microns.

The choice of grit size may be application specific, and generally a substantially uniform grit size, categorized by mesh size, may be employed in a given cutting structure although the disclosure is not so limited. Suitable mesh sizes may include, by way of example, 30/40 (660 stones per carat (SPC)), 25/25 (420 SPC), 20/25 (210 SPC) and 18/20 (150 SPC). A larger grit size, for example, 150 SPC or 210 SPC may be more suitable for drilling non-abrasive formations such as shale, while a smaller grit size, for example, 420 SPC or 660 SPC, may be employed in a more demanding, abrasive formation.

In all of the cutting structures 24 described above, an outermost end 26 of each cutting structure 24 and, if desired, one or more other surfaces, may be pre-sharpened after formation thereof to enhance exposure of particles of the abrasive material above an adjacent surface of the matrix material of the cutting structure 24. Such exposure may be enhanced before or after cutting structures 24 are located on a bit body if cutting structures 24 are preformed, such as by hot isostatic pressing, and of course, exposure of abrasive particles on cutting structures 24 formed integrally with a bit body may be enhanced in situ. Consequently, bit 10 with its pre-sharpened cutting structures 24 is enabled to drill efficiently in terms of applied WOB and resulting ROP, without a break-in period required of conventional impregnated bits. In some embodiments, exposure of the abrasive particles visible at a surface of the cutting structure 24 may be enhanced, by way of example only, to a height above a surface of adjacent matrix material of between about twenty percent (20%) of a size of the abrasive particles and about sixty percent (60%) of a size of the abrasive particles.

Figure 4:
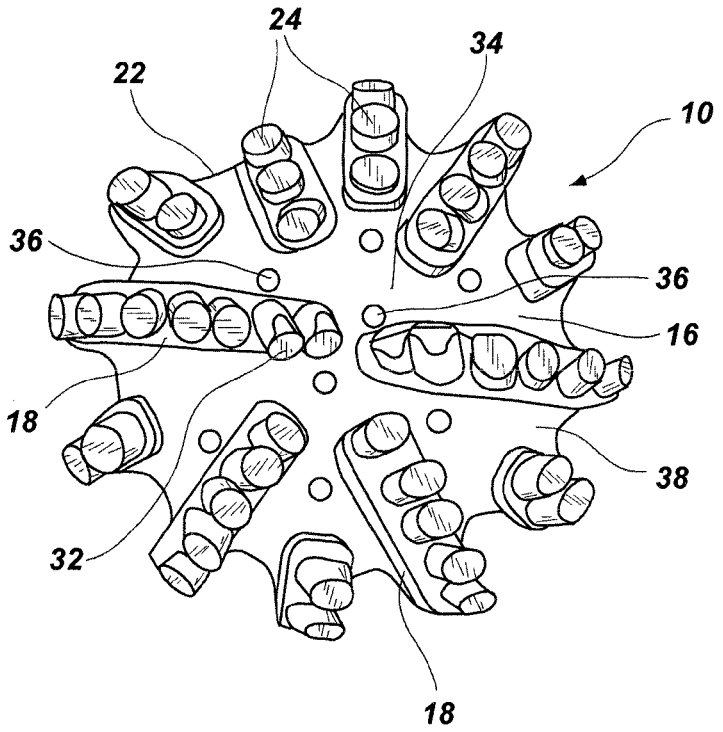
FIG. 4 is a top elevation of the bit of FIG. 1 after testing, showing wear of the discrete cutting structures and PDC cutters.

Referring now to FIG. 4, the radially innermost ends of two blades 18 extend to the centerline of bit 10 and carry cutting elements, shown as PDC cutters 32, in conventional orientations, with cutting faces oriented generally facing the direction of bit rotation. PDC cutters 32 are located within a cone portion 34 of the bit face 16. The cone portion 34, best viewed with reference to FIG. 1, is the portion of the bit face 16 wherein the profile is defined as a generally cone-shaped section about the centerline of intended rotation of the bit 10. While both discrete cutting structures 24 and PDC cutters 32 are carried by the bit 10, as is apparent in FIGS. 1 and 4, there is desirably a greater quantity of the discrete cutting structures 24 than there are PDC cutters 32.

The PDC cutters may comprise cutters having a PDC jacket or sheath extending contiguously with, and to the rear of, the PDC cutting face and over the supporting substrate. For example, a cutter of this type is offered by the assignee of the present invention, as NIAGARA™ cutters. Such cutters are further described in U.S. Pat. No. 6,401,844, issued Jun.

11, 2002, and entitled CUTTER WITH COMPLEX SUPERABRASIVE GEOMETRY AND DRILL BITS SO EQUIPPED. This cutter design provides enhanced abrasion resistance to the hard and/or abrasive formations typically drilled by impregnated bits, in combination with enhanced performance (ROP) in softer, nonabrasive formation layers interbedded with such hard formations. It is noted, however, that alternative PDC cutter designs may be implemented. Rather, PDC cutters 32 may be configured of various shapes, sizes, or materials as known by those of skill in the art. Also, other types of cutting elements may be formed within the cone portion 34 of the bit 10 depending on the anticipated application of the bit 10. For example, the cutting elements formed within the cone portion 34 may include cutters formed of thermally stable diamond product (TSP), natural diamond material, or impregnated diamond.

Again referring to FIG. 4 of the drawings, bit 10 employs a plurality (for example, eight (8)) ports 36 over the bit face 16 to enhance fluid velocity of drilling fluid flow and better apportion the flow over the bit face 16 and among fluid passages 38 between blades 18 and extending to junk slots 22. This enhanced fluid velocity and apportionment helps prevent bit balling in shale formations, for example, which phenomenon is known to significantly retard ROP. Further, in combination with the enhanced diamond exposure of bit 10, the improved hydraulics substantially enhances drilling through permeable sandstones.

Referring back to FIG. 1, by way of illustration only, the gage pads of the illustrated embodiment may be approximately 3 inches long, each comprising approximately 1.5 inches of thermally stable product (TSP) diamond and diamond grit-impregnated matrix, and approximately 1.5 inches of carbide bricks and K-type natural diamonds. Such an arrangement may likewise be applied to bits of differing diameters.

Figure 5:
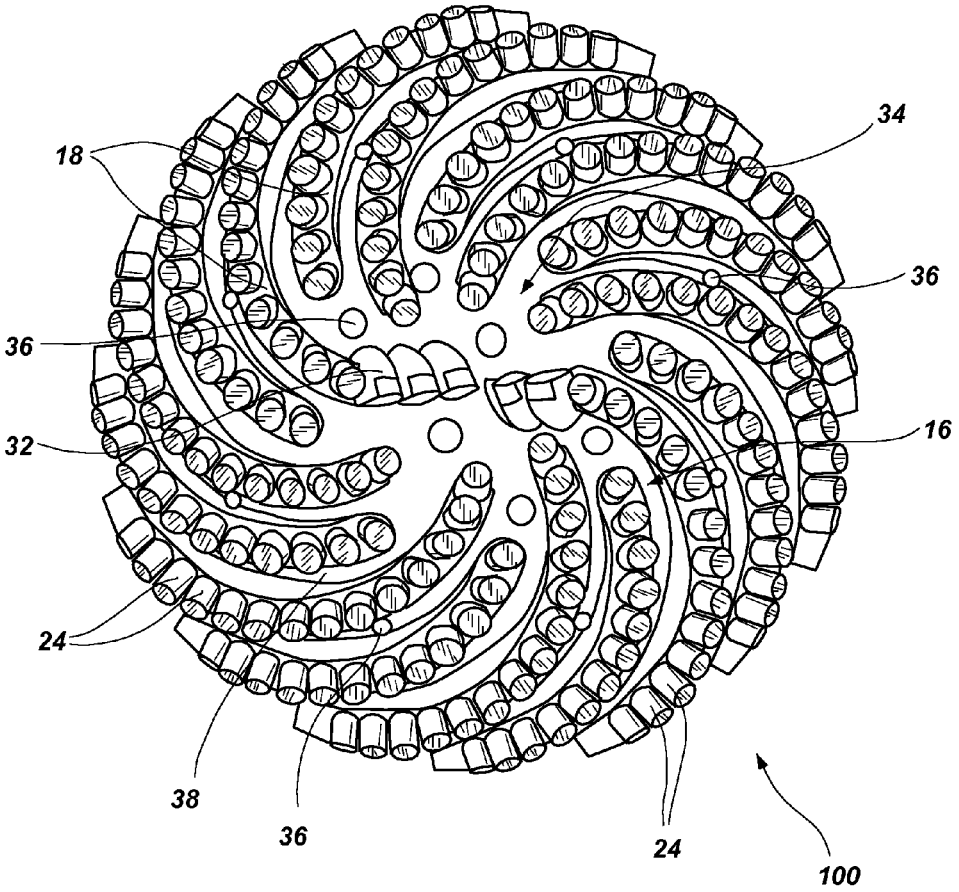
FIG. 5 is a top elevation of a second embodiment of the bit of the present disclosure.
Figure 6:
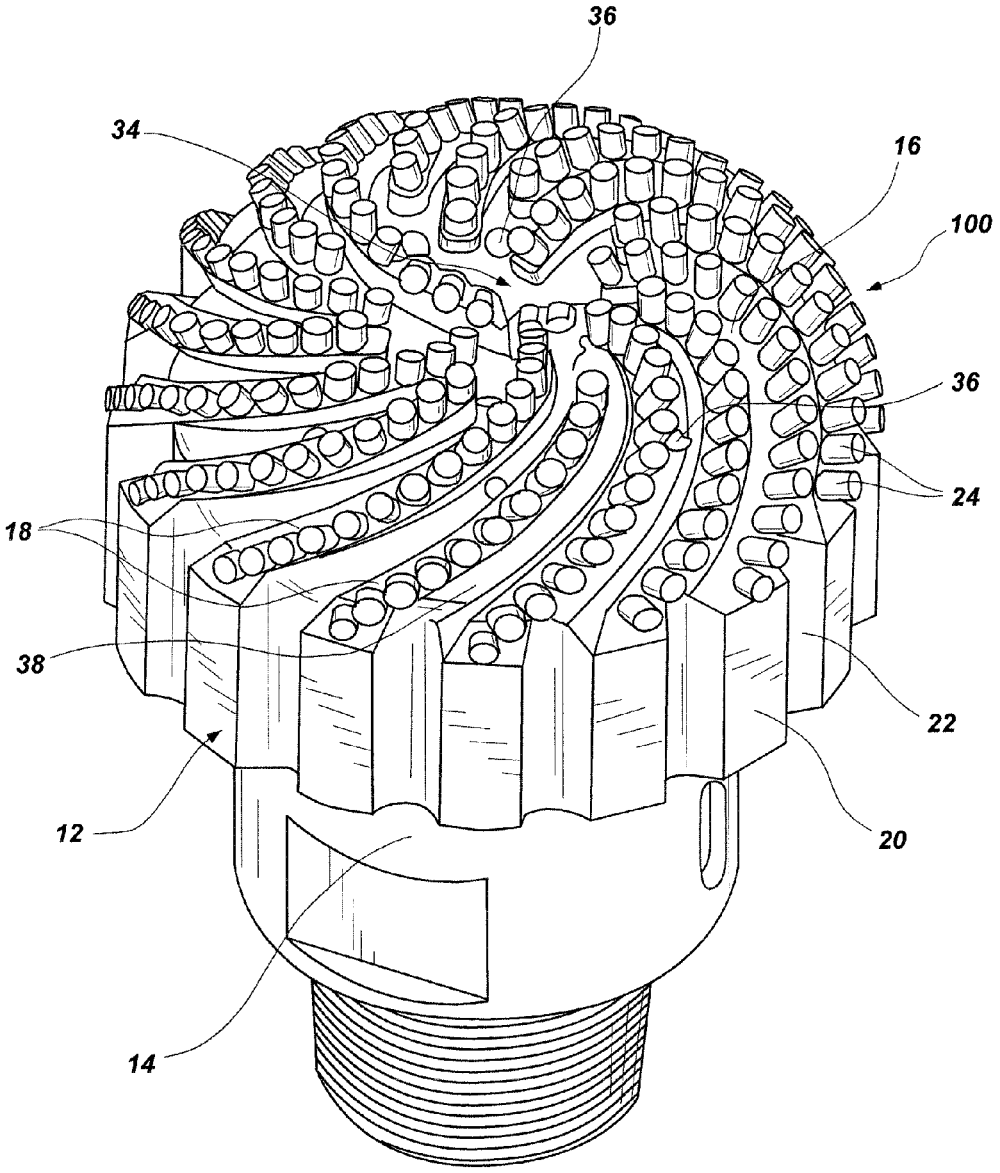
FIG. 6 is an inverted perspective view of the bit of FIG. 5.

Referring now to FIGS. 5 and 6 of the drawings, another embodiment 100 of the bit according to the disclosure is depicted. Features previously described with reference to bit 10 are identified with the same reference numerals on bit 100. It will be noted that there is a larger number of blades 18 on bit 100 than on bit 10, and that the blades 18 carrying cutting structures 24 spiral outwardly from the cone portion 34 of bit 100 toward the gage pads 20 (see FIG. 6). The use of the curved, spiraled blades 18 provides increased blade length and thus greater redundancy of coverage of discrete cutting structures 24 at each radius. It should also be noted that there are a larger number of ports 36 on bit face 16 for fluid distribution typically through nozzles (not shown) installed in the ports 36. The ports 36 within the cone portion 34 are preferably of larger diameter than those outside of the cone portion 34. Alternatively, the blades 18 may be formed in other shapes or patterns. For example, the blades 18 may be formed to extend outwardly from the cone portion 34 in a serpentine fashion, each blade forming an "S" shape as it travels across the bit face 16 toward the gage pads 20.

In all of the cutting structures described above, an outermost end 26 of each cutting structure 24 and, if desired, one or more other surfaces, may be pre-sharpened after formation thereof to enhance exposure of particles of the abrasive material above an adjacent surface of matrix material. Such exposure may be enhanced before or after cutting structures 24 are located on a bit body if cutting structures 24 are preformed, such as by hot isostatic pressing, and of course exposure of abrasive particles on cutting structures 24 formed integrally with a bit body may be enhanced in situ. Consequently, bit 100 with its pre-sharpened cutting structures 24 is enabled to drill efficiently in terms of applied WOB and resulting ROP, without a break-in period required of conventional impregnated bits. In some embodiments, exposure of the abrasive particles visible at a surface of the cutting structure may be enhanced, by way of example only, to a height above a surface of adjacent matrix material of between about twenty percent (20%) of a size of the abrasive particles and about sixty percent (60%) of a size of the abrasive particles.

Figure 7:
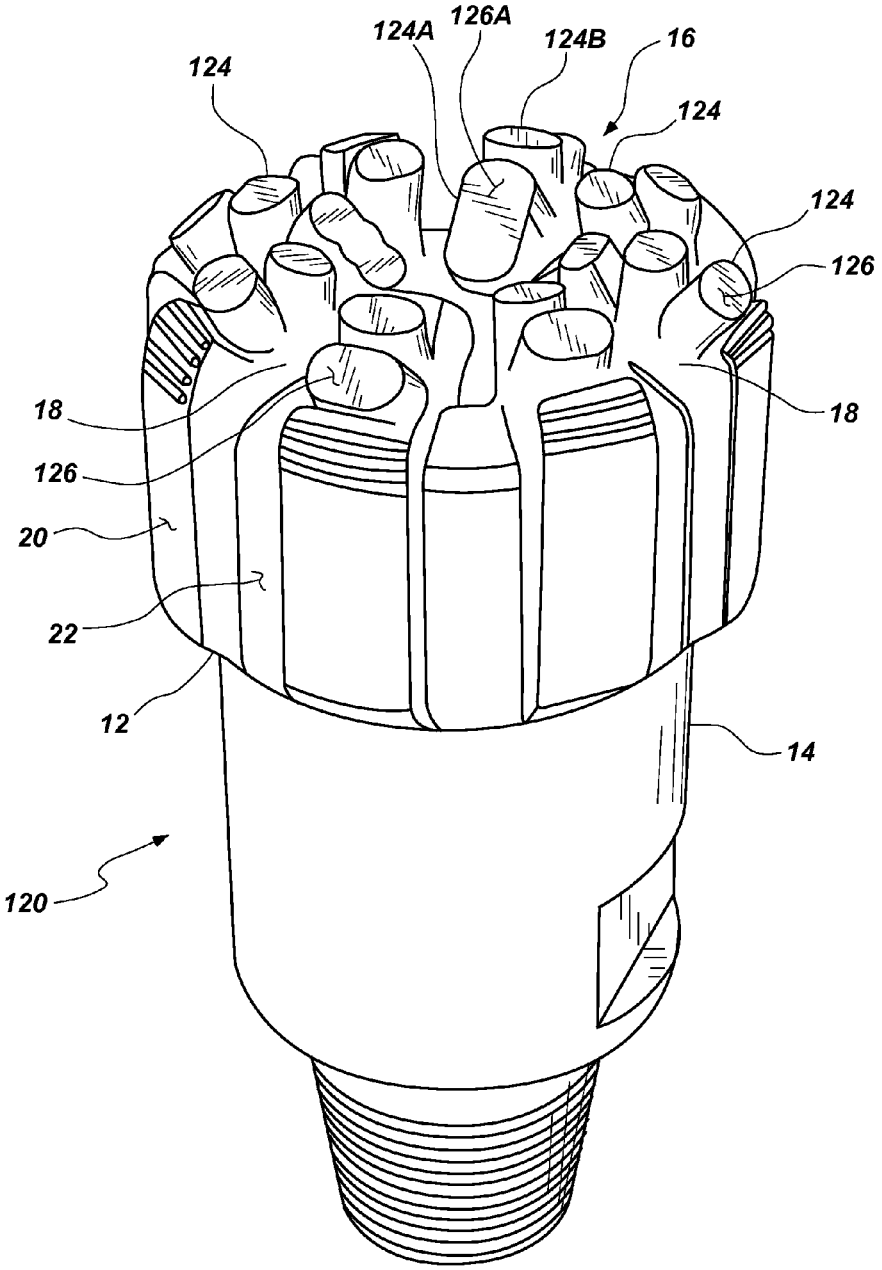
FIG. 7 is an inverted perspective view of a bit according to another embodiment of the present disclosure.

Referring now to FIG. 7, a bit 120 is shown in accordance with another embodiment of the present disclosure. As with the embodiments described above, the bit 120 includes a matrix-type bit body 12 having a shank 14, for connection with a drill string, extending therefrom opposite a bit face 16. The bit 120 also includes a plurality of blades 18 extending generally radially outwardly to gage pads 20 which define junk slots 22 therebetween.

Cutting structures 124 comprising posts extend upwardly from the blades 18 and are formed as described hereinabove. The cutting structures 124, as shown in FIG. 7, exhibit generally flat, oval cross-sectional geometries that are substantially constant from their outer ends 126 down to where they interface with the blades 18. It is noted, however, that the cutting structures 124 may exhibit other cross-sectional geometries, including those which change from their outer ends 126 to where they interface with the blades 18, as previously described herein.

The bit 120 does not necessarily include additional cutters, such as PDC cutters, in the cone portion 34 (FIG. 1) of the bit face 16. Rather, the cone portion 34 may include additional cutting structures 124A therein. The cutting structures 124A located within the cone portion 34 may exhibit geometries that are similar to those which are more radially disposed on the bit face 16, or they may exhibit geometries that are different from those which are more radially disposed on the bit face 16. For example, cutting structure 124A, as shown in FIG. 7, while exhibiting a generally flat, oval outer end 126A, exhibits dimensions which are different from those more radially outwardly disposed such that the major and minor axes of the generally oval geometry are rotated approximately 90° relative to the cutting structure 124B adjacent thereto.

In all of the cutting structures described above with respect to FIG. 7, an outermost end 126 of each cutting structure 124 (such term including cutting structures designated as 124A and 124B) and, if desired, one or more other surfaces, may be pre-sharpened after formation thereof to enhance exposure of particles of the abrasive material above an adjacent surface of matrix material. Such exposure may be enhanced before or after cutting structures 124 are located on a bit body if cutting structures 124 are preformed, such as by hot isostatic pressing, and of course exposure of abrasive particles on cutting structures 124 formed integrally with a bit body may be enhanced in situ. Consequently, bit 120 with its pre-sharpened cutting structures 124 is enabled to drill efficiently in terms of applied WOB and resulting ROP, without a break-in period required of conventional impregnated bits. In some embodiments, exposure of the abrasive particles visible at a surface of the cutting structure may be enhanced, by way of example only, to a height above a surface of adjacent matrix material of between about twenty percent (20%) of a size of the abrasive particles and about sixty percent (60%) of a size of the abrasive particles.

Figure 8:
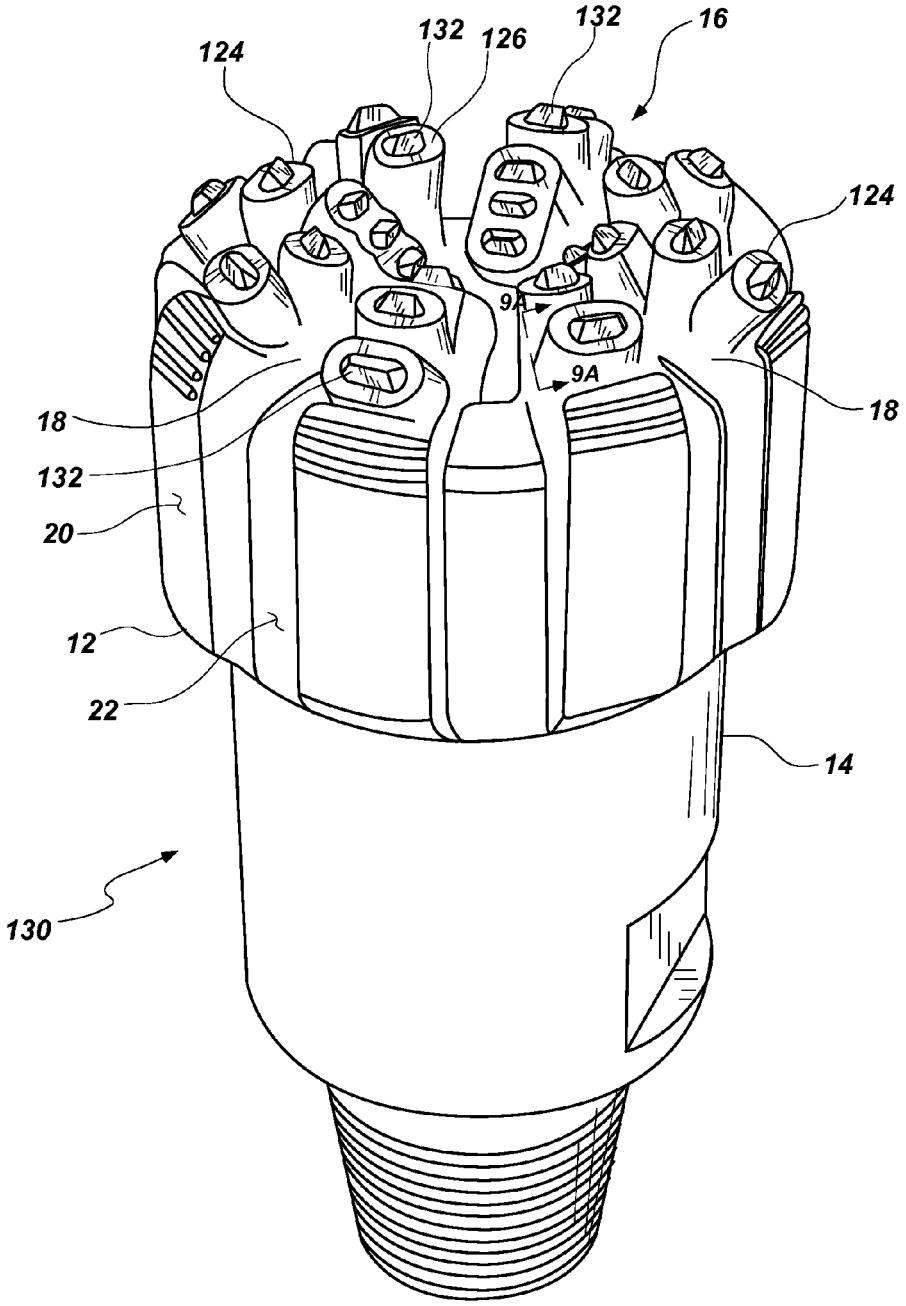
FIG. 8 is an inverted perspective view of a bit according to yet another embodiment of the present disclosure.

Referring now to FIG. 8, a drill bit 130 is shown according to yet another embodiment of the present disclosure. The drill bit 130 is configured generally similar to that which is described with respect to FIG. 7, but includes what may be termed "drill out" features which enable the bit 130 to drill through, for example, a float shoe and mass of cement at the bottom of a casing within a well bore.

Figure 9A:
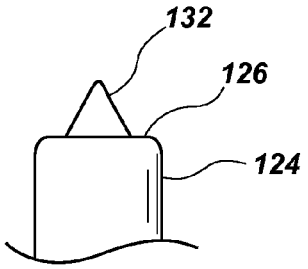
FIG. 9A is an elevational side view of a cutting structure and associated discrete protrusion as indicated by section line 9A-9A in FIG. 8.

Discrete protrusions 132, formed of, for example, a TSP material, extend from a central portion of the generally flat outer end 126 of some or all of the cutting structures 124. As shown in FIG. 9A, the discrete protrusions 132 may exhibit a substantially triangular cross-sectional geometry having a generally sharp outermost end, as taken normal to the intended direction of bit rotation, with the base of the triangle embedded in the cutting structure 124 and being mechanically and metallurgically bonded thereto. The TSP material may be coated with, for example, a refractory material such as that described hereinabove.

Figure 9B:
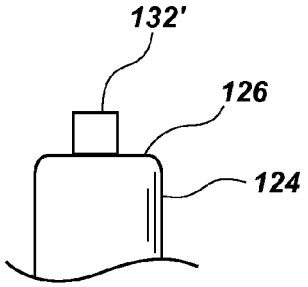
FIG. 9B is an elevational side view of a cutting structure and associated discrete protrusion according to another embodiment of the present disclosure.
Figure 9C:
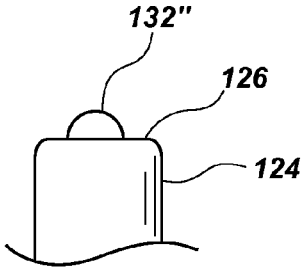
FIG. 9C is an elevational side view of a cutting structure and associated discrete protrusion according to yet another embodiment of the present disclosure.

The discrete protrusions 132 may exhibit other geometries as well. For example, FIG. 9B shows a discrete protrusion 132' having a generally square or rectangular cross-sectional geometry as taken normal to the intended direction of bit rotation and, thus, exhibits a generally flat outermost end. Another example is shown in FIG. 9C wherein the discrete protrusion 132" exhibits a generally rounded or semicircular cross-sectional area as taken normal to the intended direction of bit rotation.

As shown in FIG. 8, the cross-sectional geometry of each of the discrete protrusions 132, taken substantially parallel with the generally flat outer end 126 of its associated cutting structure 124, is generally congruous with the cross-sectional geometry of the cutting structure 124. It is noted that a portion of each of the cutting structure's outer end 126 surrounding the discrete protrusions 132 remains exposed. Thus, the discrete protrusions 132 do not completely conceal, or otherwise replace, the generally flat outer ends 126 of the cutting structures 124. Rather, discrete protrusions 132 augment the cutting structures 124 for the penetration of, for example, a float shoe and associated mass of cement therebelow or similar structure prior to penetrating the underlying subterranean formation.

As with the cutting structures described above in regard to other embodiments, an outermost end 126 of each cutting structure 124 and, if desired, one or more other surfaces, may be pre-sharpened after formation thereof to enhance exposure of particles of the abrasive material above an adjacent surface of matrix material. Such exposure may be enhanced before or after cutting structures 124 are located on a bit body if cutting structures 124 are preformed, such as by hot isostatic pressing, and of course exposure of abrasive particles on cutting structures 124 formed integrally with a bit body may be enhanced in situ. In some embodiments, exposure of the abrasive particles visible at a surface of the cutting structure may be enhanced, by way of example only, to a height above a surface of adjacent matrix material of between about twenty percent (20%) of a size of the abrasive particles and about sixty percent (60%) of a size of the abrasive particles. Consequently, once discrete protrusions 132 have augmented penetration of a float shoe and associated mass of cement and drill bit 130 has engaged formation material to drill ahead and extend the wellbore, the pre-sharpened outer ends 126 of cutting structures 124 surrounding discrete protrusions 132 are immediately effective in terms of WOB required and ROP achieved without a break-in period.

In one embodiment, impregnated cutting structures may be pre-sharpened by employing an electrodischarge machining (EDM) technique, which is also known as "spark erosion." In such a technique, an electrode is disposed against a workpiece and vibrated, while intermittent electric arcs are applied to break down adjacent metal material of the workpiece into minute particles. During this processing a dielectric coolant is pumped through a channel in the electrode to wash away the minute particles. By disposing a face of an electrode of an EDM machine proximate a surface of an impregnated cutting structure comprising, for example, diamond grit dispersed in a tungsten carbide matrix material, a surface depth of the tungsten carbide matrix material may be removed to expose diamond grit at or near the surface proximate the electrode face. Depth of matrix material removal may be controlled manually, by a program controlling the EDM machine, or by a physical stop engaging the electrode to limit its travel. A suitable depth of matrix material may be selected based at least in part on the diamond grit size employed in the cutting structure, so that excess diamond grit is not removed from the cutting structure surface being pre-sharpened.

Figure 10A:
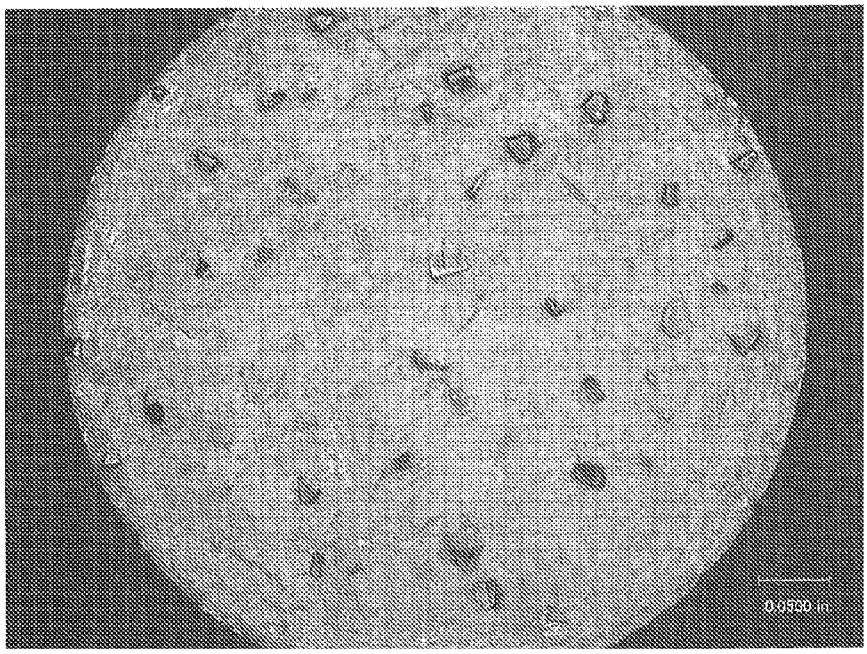
FIGS. 10A through 10D are photographs, respectively, of an end surface of an impregnated cutting structure before pre-sharpening, an end surface of an impregnated cutting structure after pre-sharpening, an enlarged photographic view of a portion of an end surface after pre-sharpening, and a comparative perspective photograph of end surfaces of impregnated cutting structures before and after pre-sharpening.
Figure 10B:
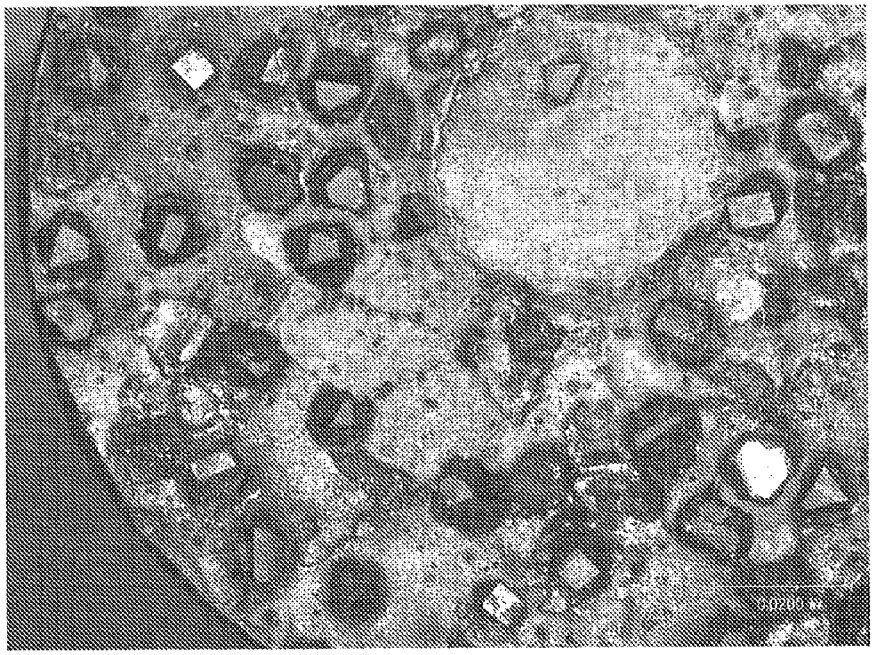
Figure 10C:
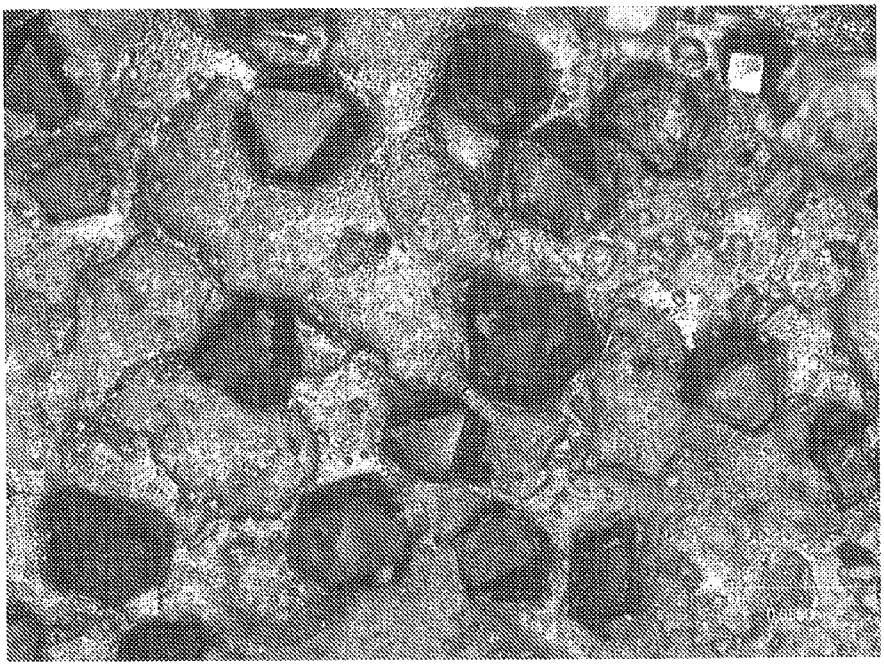
Figure 10D:
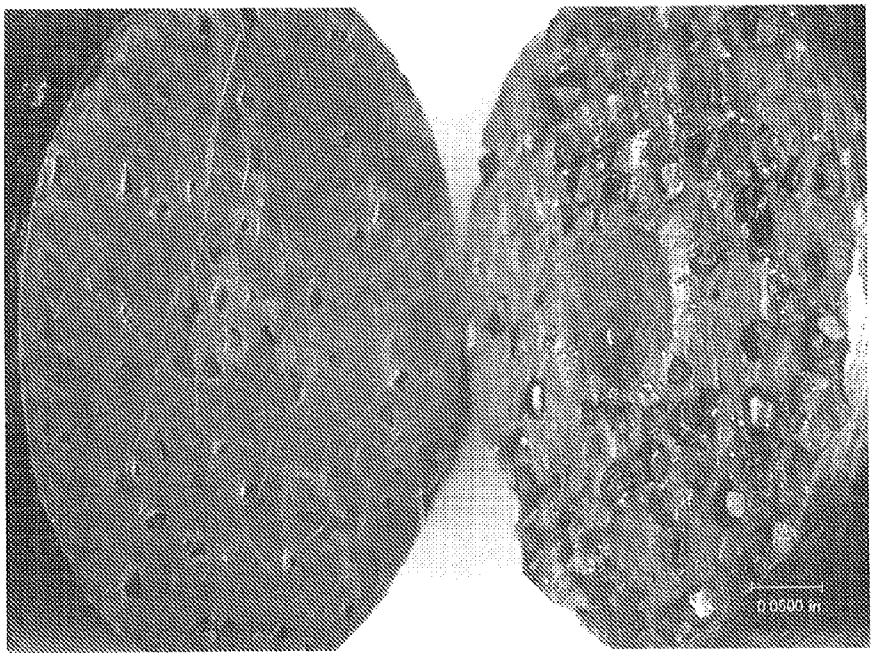
Figure 11A:
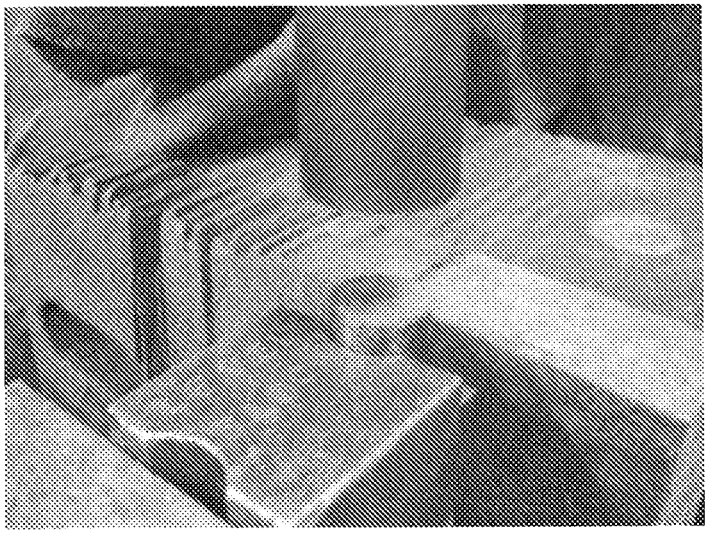
FIG. 11A is a photograph of an impregnated cutting structure with an electrode of an EDM machine above it.
Figure 11B:
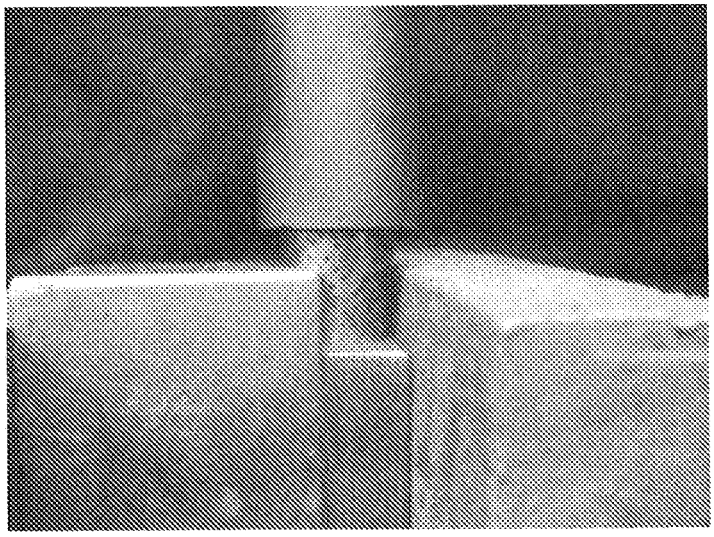
FIG. 11B is a photographic side view of an impregnated cutting structure with an electrode of an EDM machine in contact with an end surface of the cutting structure for pre-sharpening.

In one example, a Cammann Model C-106X A Metal Disintegrator available from Camman Inc. of Birmingham, Ohio, was employed to presharpen end faces of impregnated, post-shaped, round cutting structures. A #4 power setting, a vibration setting of 80-100, and a sensitivity setting of 50 were employed. The feed rate was manually controlled, and the depth of matrix material removal determined by vertical travel of the electrode. FIG. 10A of the drawings shows an end surface of one of the impregnated post test specimens prior to pre-sharpening, while FIG. 10B shows a post end surface after pre-sharpening as described above. As can be readily seen, exposure of the diamond elements is greatly enhanced. It may be noted that a center portion of the end surface in FIG. 10B has not been sharpened, due to the presence of a hole in the electrode working end (for introducing coolant through the channel in the electrode) used in the tests. FIG. 10C is an enlarged view of an impregnated post end surface after pre-sharpening, while FIG. 10D shows facing end surfaces of an as-formed impregnated post on the left and a pre-sharpened impregnated post on the right. FIG. 11A depicts a post-shaped round cutting structure as employed in the example with an electrode suspended above it. FIG. 11B is a side view of the electrode in contact with the flat end of a post-shaped round cutting structure to be pre-sharpened.

Figure 12A:
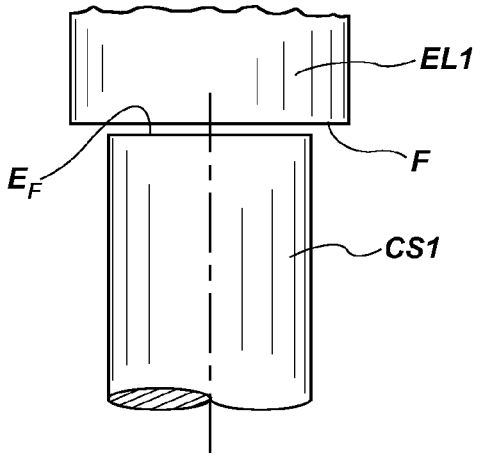
FIG. 12A is a side elevation of a post-shaped, round impregnated cutting structure having a flat end surface to be pre-sharpened with an EDM electrode having a flat working end proximate the flat end surface.
Figure 12B:
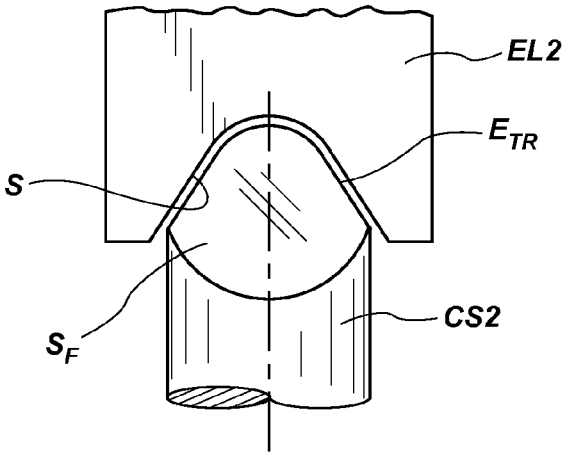
FIG. 12B is a side elevation of an impregnated cutting structure having a tapered end to be pre-sharpened with an EDM electrode having a saddled-shaped working end proximate the tapered end.
Figure 12C:
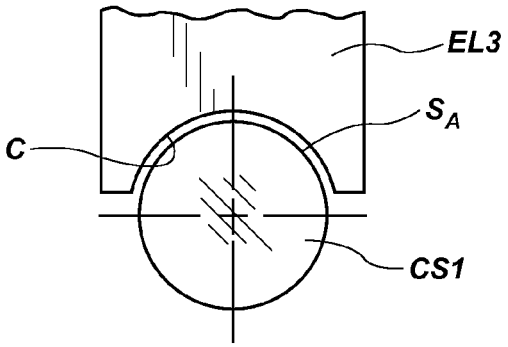
FIG. 12C is a side elevation of an impregnated cutting structure having an arcuate side portion to be pre-sharpened with an EDM electrode having a concave working end proximate the arcuate side.

While flat end surfaces of impregnated, post-shaped, round cutting structures were sharpened, other surface configurations may be sharpened with suitably configured EDM electrodes. For example, while a flat end $E_F$ of an impregnated, post-shaped cutting structure CS1 may be sharpened with an electrode EL1 employing a flat working end F as schematically depicted in FIG. 12A, a tapered, rounded end surface $E_{TR}$ of a cutting structure CS2 may be sharpened with an electrode EL2 employing a saddle-shaped working end S as depicted in FIG. 12B. Further, end flat surfaces $S_F$ on one or both sides of the tapered, rounded end surface $E_{TR}$ may be separately sharpened using an electrode EL1 with a flat working end F disposed at an appropriate angle for contact. In addition, an arcuate side surface $S_A$ of impregnated, post-shaped cutting structure such as cutting structure CS1 may be sharpened with an electrode EL3 employing an arcuate, and specifically concave, working end C as depicted in FIG. 12C. While channels for coolant are located within these electrodes, as previously described, they are not shown for enhanced drawing clarity. Sharpening of other, simple and complex surfaces may also be effected using electrodes with appropriately shaped working ends and cooling channels and oriented at suitable angles with respect to surfaces to be pre-sharpened.

It is also contemplated that other techniques may be employed in a pre-sharpening process, including without limitation laser machining, electrolytic etching and chemical etching. An approach with any of these techniques, as well as with the EDM technique described above, is to employ a minimum amount of energy, and particularly applied heat, to remove the matrix material without damaging the superabrasive (e.g., diamond) particles embedded in the matrix. Significant, heat-induced degradation of diamond in an ambient environment (e.g., not inert oxygen-free or a vacuum) may commence at a temperature of about 750° C., due to a tendency toward back-graphitization of the diamond augmented by the presence of any group VIII catalyst metals which may be present in the matrix material, which conventionally may be cobalt-cemented tungsten carbide.

Further, it is desirable that the sharpening process create a reasonably uniform pattern of exposed superabrasive particles above the matrix material surface so that substantially all of a pre-sharpened surface commences to cut formation material with a similar degree of aggressivity.

In tests using post-shaped, round impregnated post test specimens pre-sharpened as noted above, pre-sharpened test specimens demonstrated excellent rock cutting efficiency from inception of testing on a visual single point (VSP) test machine. In fact, surprisingly, the pre-sharpened test specimens were substantially more efficient than cutting efficiency of blunt (unsharpened) test specimens of the same construction even after a substantial period of testing time.

Additional non-limiting example embodiments of the disclosure are described below.

Embodiment 1

A method of pre-sharpening a cutting structure for subterranean use and comprising superabrasive material particles dispersed in a metal matrix material, the method comprising:

selecting at least one surface of the cutting structure; and removing a depth of the metal matrix material from the at least one selected surface to at least one of enhance exposure of superabrasive particles exposed above the at least one selected surface and expose portions of unexposed superabrasive particles adjacent the at least one selected surface.

Embodiment 2

The method of embodiment 1, wherein removing a depth of the metal matrix material comprises electrodischarge machining the matrix material.

Embodiment 3

The method of embodiment 1, wherein removing a depth of the metal matrix material comprises one of laser machining, electrolytic etching and chemical etching of the matrix material.

Embodiment 4

The method of any of embodiments 1 through 3, wherein removing a depth of the metal matrix material comprises removing a substantially uniform depth of the matrix material from the at least one selected surface.

Embodiment 5

The method of any of embodiments 1 through 4, wherein removing a depth of the matrix material from the at least one selected surface to at least one of enhance exposure of superabrasive particles exposed above the at least one selected surface and expose portions of unexposed superbrasive particles adjacent the at least one selected surface further comprises both enhancing exposure of superabrasive particles exposed above the at least one selected surface and exposing portions of unexposed superbrasive particles adjacent the at least one selected surface.

Embodiment 6

The method of any of embodiments 1 through 5, wherein removing a depth of the metal matrix material from the at least one selected surface comprises removing a depth of the matrix material from at least one of a flat surface, an arcuate surface, and a surface comprising at least flat and arcuate portions.

Embodiment 7

The method of any of embodiments 1 through 6, further comprising pre-sharpening the cutting structure and subsequently securing the pre-sharpened cutting structure to a portion of a bit.

Embodiment 8

The method of embodiments 1 through 6, further comprising securing the cutting structure to a portion of a bit, and pre-sharpening the cutting structure thereafter.

Embodiment 9

The method of any of embodiments 1 through 8, wherein the superabrasive material particles comprise at least one of natural diamond grit, synthetic diamond grit, and cubic boron nitride.

Embodiment 10

The method of any of embodiments 1 through 9, wherein the superabrasive material particles comprise a coating including a refractory material.

Embodiment 11

The method of embodiment 10, wherein the refractory material comprises at least one of a refractory metal, a refractory metal carbide and a refractory metal oxide.

Embodiment 12

An unused impregnated cutting structure for subterranean use comprising superabrasive material particles dispersed in a metal matrix material and exhibiting substantial exposure of portions thereof above at least one surface comprising the metal matrix material.

Embodiment 13

The cutting structure of embodiment 12, wherein the superabrasive material particles comprise at least one of natural diamond grit, synthetic diamond grit, and cubic boron nitride.

Embodiment 14

The cutting structure of embodiment 12 or 13, wherein the superabrasive material particles comprise a coating including a refractory material.

Embodiment 15

The cutting structure of embodiment 14, wherein the refractory material comprises at least one of a refractory metal, a refractory metal carbide and a refractory metal oxide.

Embodiment 16

The cutting structure of any of embodiments 12 through 15, wherein the superabrasive material particles are metallurgically bonded to the metal matrix material through a refractory metal.

Embodiment 17

A bit for subterranean use having at least one unused cutting structure thereon, the at least one unused cutting structure comprising superabrasive particles dispersed in a metal matrix material and exhibiting substantial exposure of portions thereof above at least one surface of the metal matrix material.

Embodiment 18

The bit of embodiment 17, wherein the superabrasive material particles comprise at least one of natural diamond grit, synthetic diamond grit, and cubic boron nitride.

Embodiment 19

The bit of embodiment 17 or 18, wherein the superabrasive material particles comprise a coating including a refractory material.

Embodiment 20

The bit of embodiment 19, wherein the refractory material comprises at least one of a refractory metal, a refractory metal carbide and a refractory metal oxide.

Embodiment 21

The bit of any of embodiments 17 through 20, wherein the superabrasive material particles are metallurgically bonded to the metal matrix material through a refractory metal material.

While the present disclosure been described with reference to certain illustrated embodiments, those of ordinary skill in the art will recognize and appreciate that it is not so limited. Additions, deletions and modifications to the embodiments illustrated and described herein may be made without departing from the scope of the disclosure as defined by the claims herein, and legal equivalents. Similarly, features from one embodiment may be combined with those of another.

What is claimed is:

1. A method of pre-sharpening an impregnated cutting structure for a bit for subterranean use, the impregnated cutting structure comprising superabrasive material particles dispersed in and mutually separated by a metal matrix material, the method comprising, prior to placing the impregnated cutting structure in a wellbore on the bit:

selecting at least one formation engaging surface of the impregnated cutting structure; and removing a depth of the metal matrix material by machining the metal matrix material of the at least one selected formation engaging surface adjacent, between and separating superabrasive particles dispersed therein to at least one of enhance exposure of already exposed superabrasive particles to an increased height above the metal matrix material or expose portions of unexposed superabrasive particles adjacent the metal matrix material.

2. The method of claim 1, wherein removing the depth of the metal matrix material by machining the metal matrix material of the at least one selected formation engaging surface comprises electrodischarge machining the metal matrix material.

3. The method of claim 1, wherein removing the depth of the metal matrix material by machining the metal matrix material of the at least one selected formation engaging surface comprises laser machining of the metal matrix material.

4. The method of claim 1, wherein removing the depth of the metal matrix material comprises removing a substantially uniform depth of the metal matrix material from the at least one selected formation engaging surface of the impregnated cutting structure.

5. The method of claim 1, wherein removing the depth of the metal matrix material by machining the metal matrix material of the at least one selected formation engaging surface adjacent, between and separating the superabrasive particles dispersed therein to at least one of enhance exposure of already exposed superabrasive particles to the increased height above the metal matrix material or expose portions of unexposed superbrasive particles adjacent the metal matrix material further comprises both enhancing exposure of the already exposed superabrasive particles to the increased height above the metal matrix material and exposing portions of the unexposed superbrasive particles adjacent the metal matrix material.

6. The method of claim 1, wherein removing the depth of the metal matrix material by machining the metal matrix material of the at least one selected formation engaging surface adjacent, between and separating the superabrasive particles dispersed therein comprises removing the depth of the metal matrix material from at least one of a flat surface, an arcuate surface, or a surface of the metal matrix material comprising at least flat and arcuate portions.

7. The method of claim 1, further comprising securing the pre-sharpened impregnated cutting structure to a portion of a bit.

8. The method of claim 1, further comprising securing the impregnated cutting structure to a portion of a bit, and pre-sharpening the impregnated cutting structure thereafter.

9. The method of claim 1, wherein the superabrasive material particles comprise at least one of natural diamond grit, synthetic diamond grit, or cubic boron nitride.

10. The method of claim 1, wherein the superabrasive material particles comprise a coating including a refractory material.

11. The method of claim 10, wherein the refractory material comprises at least one of a refractory metal, a refractory metal carbide or a refractory metal oxide.

12. An unused impregnated cutting structure for drill bits for subterranean use comprising superabrasive material particles dispersed in a metal matrix material and exhibiting substantial exposure of portions thereof above at least one formation engaging surface comprising the metal matrix material, the substantial exposure resulting from removal of a depth of metal matrix material by machining the metal matrix material of the at least one formation engaging surface adjacent, between and separating superabrasive particles after formation of the impregnated cutting structure.

13. The cutting structure of claim 12, wherein the superabrasive material particles comprise at least one of natural diamond grit, synthetic diamond grit, or cubic boron nitride.

14. The cutting structure of claim 12, wherein the superabrasive material particles comprise a coating including a refractory material.

15. The cutting structure of claim 14, wherein the refractory material comprises at least one of a refractory metal, a refractory metal carbide or a refractory metal oxide.

16. The cutting structure of claim 14, wherein the superabrasive material particles are metallurgically bonded to the metal matrix material through the coating.

17. A bit for subterranean use having at least one unused impregnated cutting structure thereon, the at least one unused impregnated cutting structure comprising superabrasive material particles dispersed in a metal matrix material and exhibiting substantial exposure of portions thereof above at least one formation engaging surface of the metal matrix material, the substantial exposure resulting from removal of a depth of metal matrix material by machining the metal matrix material of the at least one formation engaging surface adjacent, between and separating superabrasive particles after formation of the at least one unused impregnated cutting structure.

18. The bit of claim 17, wherein the superabrasive material particles comprise at least one of natural diamond grit, synthetic diamond grit, or cubic boron nitride.

19. The bit of claim 17, wherein the superabrasive material particles comprise a coating including a refractory material.

20. The bit of claim 19, wherein the refractory material comprises at least one of a refractory metal, a refractory metal carbide or a refractory metal oxide.

21. The bit of claim 19, wherein the superabrasive material particles are metallurgically bonded to the metal matrix material through the coating.

* * * * *